US006905198B2

(12) United States Patent
Studer et al.

(10) Patent No.: US 6,905,198 B2
(45) Date of Patent: Jun. 14, 2005

(54) LIQUID SUPPLY VESSEL

(75) Inventors: Anthony D. Studer, Albany, OR (US); Kevin D. Almen, Albany, OR (US); Cary R. Bybee, Lebanon, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 11 days.

(21) Appl. No.: 10/625,589

(22) Filed: Jul. 24, 2003

(65) Prior Publication Data

US 2005/0018022 A1 Jan. 27, 2005

(51) Int. Cl.[7] ..... B41J 2/175
(52) U.S. Cl. ..... 347/86
(58) Field of Search ..... 347/17, 85, 86, 347/87, 92; 222/501

(56) References Cited

U.S. PATENT DOCUMENTS 3,953,862 A * 4/1976 Amberntsson et al. ..... 347/87
4,419,677 A * 12/1983 Kasugayama et al. ..... 347/87
4,429,320 A * 1/1984 Hattori et al. ..... 347/86
5,425,478 A * 6/1995 Kotaki et al. ..... 222/501
5,612,727 A 3/1997 Morimoto et al.
5,643,467 A 7/1997 Romanco
5,801,737 A * 9/1998 Sato et al. ..... 347/86
5,929,882 A 7/1999 Sharpe
5,975,330 A 11/1999 Sasaki et al.
6,137,513 A 10/2000 Pawlowski, Jr. et al.
6,145,970 A 11/2000 Sasaki et al.
6,250,747 B1 6/2001 Hauck
6,286,948 B1 9/2001 Wu et al.
6,293,666 B1 9/2001 Mou et al.
6,440,352 B1 8/2002 Sasaki et al.
6,494,568 B2 12/2002 Hou et al.
6,513,919 B2 2/2003 Shyn et al.
6,540,341 B2 4/2003 Hsieh et al.
6,676,253 B2 * 1/2004 Hsu et al. ..... 347/86

* cited by examiner

*Primary Examiner*—Anh T.N. Vo

(57) ABSTRACT

A high efficiency, liquid supply vessel is provided. The liquid supply vessel includes a chamber, either an open-foam or septum-based fluidic interconnect, a tower, and at least one gas-permeable vent. The tower includes a valve which remains closed when the vessel is inserted into a printer and the fluidic interconnect is engaged, thereby retaining the liquid in the vessel. When the printhead is operated, a sufficient vacuum is created to open the valve, thereby supplying the liquid to the printhead. Whereas the vacuum pressure may otherwise rise to unacceptable levels, the gas-permeable vent enables the pressure to be equalized. Similarly, the vent equalizes pressure during altitude and/or temperature changes, thereby preventing pressure increases or decreases which would otherwise be associated with such changes.

27 Claims, 3 Drawing Sheets

LIQUID SUPPLY VESSEL

BACKGROUND

Liquid supply vessels, such as, for example, ink cartridges for printers have a liquid yield which is a generally defined volume of liquid (e.g., ink) expunged from the vessel divided by the volume of liquid originally present in the vessel. Improving the yield lengthens the life of the vessel and, therefore, improves the value of the vessel.

In ink cartridges, often the liquid yield may be around 0.75. As a result, roughly 25% of the ink originally present in the cartridge is "lost," i.e., it remains in the cartridge and is unable to be dispensed. One reason that ink remains in the cartridge is due to mechanical stranding where ink gets trapped in low lying areas inside the cartridge. The ink gets trapped due to inefficiencies caused by geometry (i.e., a flaccid bag used to contain the ink), or by the variation in capillary sizes if foam is used to contain the ink. By extending the life of an ink cartridge, printer downtime will be reduced. Moreover, by improving the ink yield, the cost associated with printing will also be reduced.

Accordingly, what is needed is a liquid supply vessel, such as, for example, an ink cartridge, which addresses one or more of the aforementioned deficiencies in the prior art.

SUMMARY

One embodiment of the invention addresses a liquid supply vessel comprising: (a) a chamber adapted to contain a liquid, wherein the chamber comprises a floor having an opening thereon; (b) a liquid dispensing apparatus having an intake and an outtake, wherein a valve is positioned between the intake and the outtake, and wherein the outtake is aligned with the opening; (c) a supply line having an inlet adjacent the floor and an outlet in fluid communication with the intake, wherein the supply line extends from the floor and is substantially housed within the chamber; and (d) at least one vent formed in a wall of the chamber, wherein the at least one vent is adapted to be exposed to a liquid contained within the chamber, and wherein the at least one vent is permeable to gas but impermeable to liquid.

The invention also addresses a method of preventing back-pressure from developing in a chamber in a liquid supply vessel when the amount of liquid in the chamber decreases, and of equalizing pressure in a chamber in a liquid supply vessel when the altitude and/or temperature at which the vessel is maintained is changed. This method includes: (a) providing a chamber containing the liquid; (b) expunging at least some of the liquid from the chamber through an opening; and (c) sucking gas into the chamber in a manner that is impermeable to liquid to equalize the pressure in the chamber with the ambient pressure exterior of the chamber, to prevent back-pressure from developing in the chamber.

These and other features, aspects, and advantages of the present invention will become more apparent from the following description, appended claims, and accompanying exemplary embodiments shown in the drawings.

DETAILED DESCRIPTION

Figure 1:
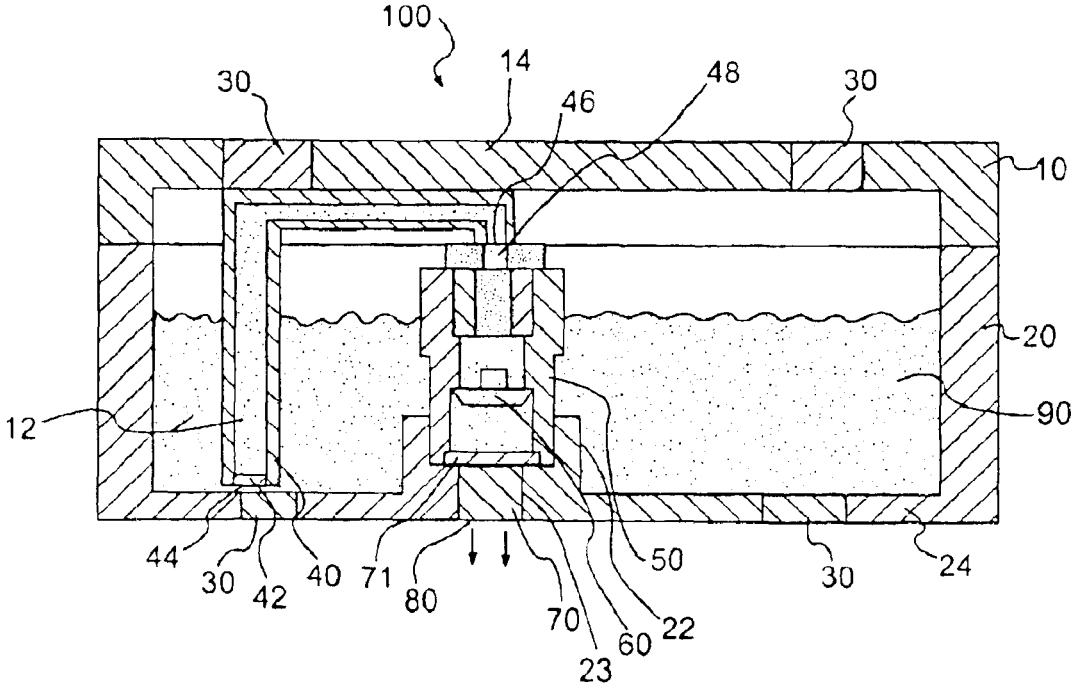
FIG. 1 is a cross-sectional view of a liquid supply vessel according to one exemplary embodiment of the invention having an open-foam fluidic interconnect.

Reference will now be made in detail to various embodiments of the invention, which are illustrated in the drawings. An effort has been made to use the same reference numbers throughout the drawings to refer to the same or like parts.

FIG. 1 shows a cross-sectional view of a liquid supply vessel 100 according to one embodiment of the invention. The vessel 100 is formed of two parts, a cover 10 and a base 20 which may be joined and sealed together by at least one fastener and gasket (not shown). As shown, the cover 10 and the base 20 have recessed portions such that when the cover 10 is placed on top of the base 20, a chamber 90 is formed. The chamber 90 is designed to contain a liquid 12, such as, for example, ink.

When the cover 10 is placed on top of the base 20, a top wall 14 of the cover 10 is opposite a floor 24 of the base 20. At least one vent 30 is formed in the top wall 14 and/or the floor 24. The vessel 100 may have at least four vents 30, two of which will be formed in the top wall 14 and two of which will be formed in the floor 24. Further, each of the vents 30 is gas permeable, but substantially liquid impermeable. One example of such a vent 30 may be an oleophobic membrane with a 0.45 $\mu$m pore size and a polypropylene backer which engages a polypropylene fitting (not shown) that is threaded in the top wall 14 or floor 24. To protect the vent 30 physically, the vent 30 may be recessed from the outer surface of the vessel (not shown); a labyrinthine pathway (not shown) may also be interposed between the vent 30 and the ambient air to reduce the water vapor transmission rate (WVTR) from the vessel.

As a result of being gas permeable, but substantially liquid impermeable, the liquid 12 within the chamber 90 is unable to pass through the vents 30. Further, to equalize the pressure within the chamber 90 with the ambient pressure exterior of the chamber 90, gas (e.g., air) can be exhausted or sucked through the vents 30, as hereafter described in detail.

As a result of the vents 30, if the altitude and/or the temperature at which the vessel 100 is maintained increases (such as, for example, if the vessel 100 were in an ascending plane and/or placed near a heat source), the pressure in the chamber 90 will not increase (as would normally be the case for a closed container) due to exhaustion of some of the gas in the chamber 90 through the vents 30. Similarly, when the altitude and/or temperature at which the vessel 100 is maintained decreases (such as, for example, if the vessel 100 were in a descending plane and/or placed near a cooling source), the pressure in the chamber will not decrease (as would normally be the case for a closed container) due to gas being sucked into the chamber 90 through the vents 30.

The vents 30 also eliminate (or at least substantially reduce) any back-pressure in the chamber 90 that would otherwise be caused by liquid 12 being expunged from the chamber 90. Rather, as the liquid 12 is expunged, gas is sucked into the chamber 90 through the vents 30 thereby enabling the pressure in the chamber 90 to remain equalized with the ambient pressure exterior of the chamber 90, i.e., the vents 30 prevent the formation of a vacuum in the chamber 90.

To expunge the liquid 12 in the chamber 90, it is pumped into a dispensing tower 50 by means of a supply line 40 (also referred to as an "inverted snorkel" or "siphon" 40). The supply line has an inlet 44 adjacent the floor 24. This inlet 44 serves as an intake port for the supply line 40. A filter 42, which substantially prevents the passage of air bubbles when wetted, due to surface tension, is provided in the inlet 44. The filter may be a low-micron screen which greatly reduces the likelihood that any impurities in the liquid 12 in the chamber 90 will be transmitted into the supply line 40.

Figure 2:
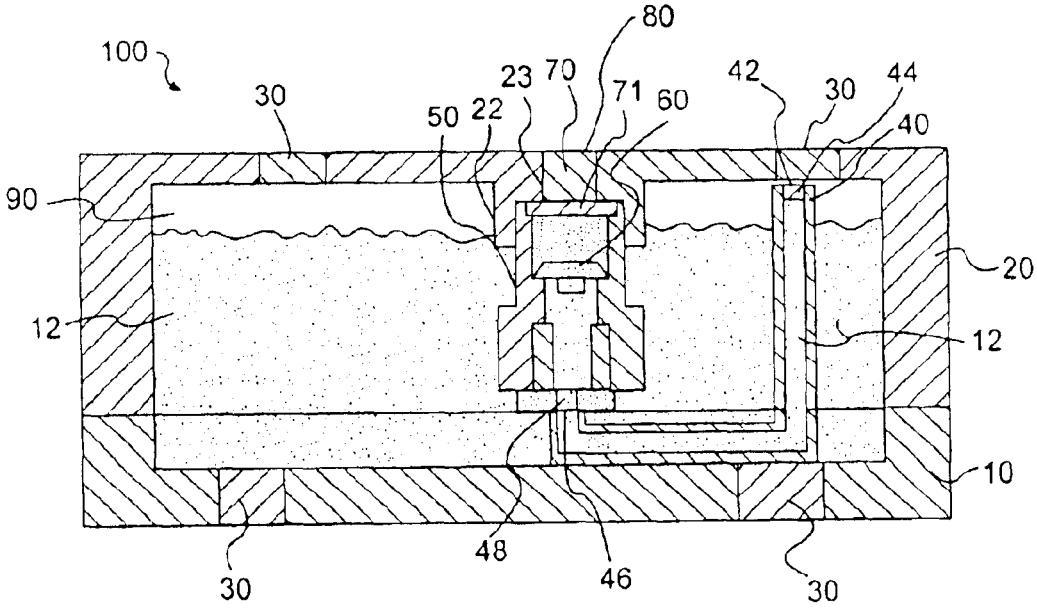
FIG. 2 is an inverted view of the exemplary embodiment of FIG. 1 showing how a supply line may act as an inverted snorkel or siphon.

As previously mentioned, the filter 42 in the inlet 44 substantially blocks gas bubbles when wetted; the importance of this feature is shown in FIG. 2, which shows the vessel 100 of FIG. 1 in an inverted state. Although the vessel 100 may be kept in the upright orientation shown in FIG. 1, it is practically understood that the vessel 100 will likely be inverted during its lifetime such as, for example, when a box of vessels 100 is improperly stored upside-down by a vender or when a consumer puts a box containing a vessel 100 upside-down in a bag.

In the inverted state shown in FIG. 2, the liquid 12 in the chamber 90 falls (under the force of gravity) to the top wall 14. As a result, the inlet 44 of the supply line 40 may project out of the surface of the liquid 12 in a manner similar to that of a snorkel projecting out of the surface of an ocean. In this position, the inlet 44 of the supply line 40 may be exposed to the gas in the chamber 90 which fills that portion of the chamber 90 which is not occupied by the liquid 12. If the filter 42 were not provided, the gas in the chamber 90 could enter the supply line 40, thereby negatively impacting print quality. As a result of the filter 42, however, the gas in the chamber 90 is substantially prevented from entering the supply line 40.

With respect to FIG. 1, the liquid 12 which is sucked through the filter 42 and into the supply line 40, passes through the supply line 40 and exits through an outlet 46. The liquid 12 exiting the outlet 46 passes into a tower 50. The tower 50 contains an intake 48 which is in fluid communication with the outlet 46 and with a valve 60. The tower 50 rests within an upper bore 22 which projects upward from the floor 24. A lower bore 23, which is concentric with the upper bore 22, is designed to house a fluidic interconnect 80.

For the vessel 100 to be compatible with some existing printheads, it may have an outtake (a.k.a. "fluidic interconnect") 80 which is open-foam 70 based in combination with a filter screen 71. Similarly, in a vessel 200 according to another embodiment (shown in FIG. 3), the fluidic interconnect 80 may be designed to engage printheads having a needle (not shown) which pierces a septum 72.

If the foam-based 70 fluidic interconnect 80 is employed, the fluidic interconnect may have a large surface area that is exposed to the atmosphere before the vessel 100 inserted in to a printer, after the customer removes the label protecting the fluidic interconnect 80. As a result, the valve 60 must operate reliably and the internal supply pressure must never rise above the cracking pressure of the valve 60; else, liquid 12 could leak out of the fluidic interconnect 80. To achieve these requirements, the vents 30 serve to reduce back-pressure and the valve 60 design also reduces the potential for leakage.

Figure 3:
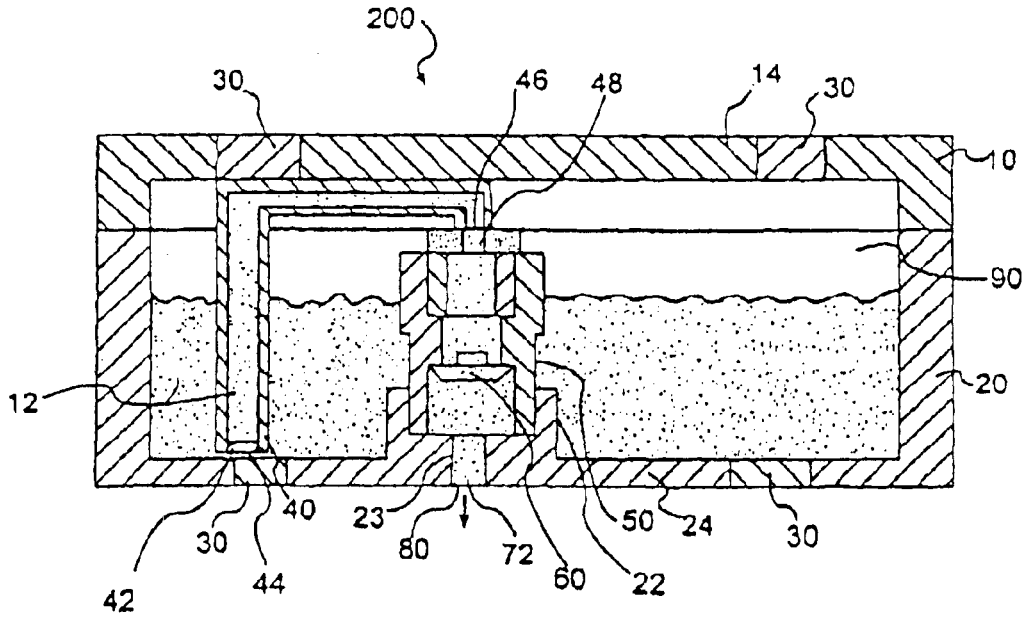
FIG. 3 is a cross-sectional view of a liquid supply vessel according to a second exemplary embodiment of the invention in which a needle/septum fluidic interconnect replaces the open-foam of the previous embodiment.

In choosing a valve 60, it should be appreciated that the vessel 100 will likely operate in the 1"–8" Water back-pressure range. In addition, as a result of the small size of the chamber 90, the valve 60 must be miniaturized to fit within the tower 50. As a result of these considerations, in one embodiment the valve 60 may be an umbrella valve. Further, the umbrella valve may be about 6.4 mm in size, may have a cracking pressure of about 5.7" Water, and may be designed to operate in a 3"–5" Water pressure range. In addition, the reliability of the valve 60 is enhanced by placing it towards the upper end of the tower 50, as shown in FIGS. 1 and 3. By placing the valve 60 near the upper end of the tower 50, the positive head pressure acting on the valve is reduced.

Regardless of the vessel embodiment, when the vessel 100, 200 is manufactured, the chamber 90 may be filled with liquid 12. After the chamber 90 is filled, the supply line 40 and the tower 50 are primed, i.e., liquid 12 is sucked through the supply line 50 and into the tower 50 up to the valve 60. By filling the supply line 40 and tower 50 with liquid 12, air expansion in the supply line 40 and/or tower 50 during altitude/temperature changes is minimized, thereby substantially reducing the likelihood of breakage and leakage. In addition, upon insertion of the vessel 100, 200 into a printhead, a pocket of gas will not be driven into the printhead upon start-up.

When the vessel 100, 200 is inserted in a printhead and a request for liquid is initiated, suction applied to the valve 60 will cause it to open. When the valve 60 opens, liquid will flow through the tower 50 and out the fluidic interconnect in the direction of the arrows shown in FIGS. 1 and 3.

The invention herein described can, in some exemplary embodiments, reduce the "stranded" ink in a container to about 3%, compared to about 30% or more in a foam-based container. Moreover, these improved yields may occur at a flow rate of 0.5–1.5 cc per minute. In addition, in some embodiments, the simplicity of the design yields low manufacturing costs. Further, in some embodiments there is no flow restriction to limit the print speed.

Some embodiments of the invention also reduce mechanical stress by eliminating (or at least substantially reducing) back-pressure caused by ink expulsion. Similarly, the gas permeable vents equalize the pressure within the chamber with the ambient pressure exterior of the chamber, thereby eliminating (or at least substantially reducing) any mechanical stress which would otherwise act on the vessel as a result of a change in altitude and/or temperature. As a result, the invention is more durable, decreases the number of customer interventions, is significantly more cost effective and, is significantly more environmentally friendly.

Although the aforementioned describes embodiments of the invention, the invention is not so restricted. It will be apparent to those skilled in the art that various modifications and variations can be made to the disclosed embodiments of the present invention without departing from the scope or spirit of the invention. Accordingly, these other liquid supply vessels are fully within the scope of the claimed invention. Therefore, it should be understood that the apparatus and method described herein are illustrative only and are not limiting upon the scope of the invention, which is indicated by the following claims.

What is claimed is:

1. A liquid supply vessel comprising:

a chamber adapted to contain a liquid, wherein the chamber comprises a floor having an opening thereon;

a liquid dispensing apparatus having an intake and an outtake, wherein a valve is positioned between the intake and the outtake, and wherein the outtake is aligned with the opening;

a supply line having an inlet adjacent the floor and an outlet in fluid communication with the intake, wherein the supply line extends from the floor and is substantially housed within the chamber; and at least one vent formed in a wall of the chamber, wherein the at least one vent is adapted to be exposed to a liquid contained within the chamber, and wherein the at least one vent is permeable to gas but substantially impermeable to liquid.

2. The liquid supply vessel according to claim 1, further comprising: a filter provided in the inlet of the supply line.

3. The liquid supply vessel according to claim 2, wherein the filter is adapted to prevent impurities in a liquid in the chamber from entering the supply line.

4. The liquid supply vessel according to claim 3, wherein the filter substantially blocks air bubbles when wetted.

5. The liquid supply vessel according to claim 1, wherein the valve is an umbrella valve.

6. The liquid supply vessel according to claim 1, wherein the at least one vent is adapted to equalize the pressure within the chamber and the ambient pressure exterior of the chamber.

7. The liquid supply vessel according to claim 6, wherein when the altitude and/or temperature at which the vessel is maintained is increased, gas within the chamber passes through the at least one vent to equalize the pressure within the chamber to the ambient pressure exterior of the chamber.

8. The liquid supply vessel according to claim 6, wherein when the altitude and/or temperature at which the vessel is maintained is decreased, gas exterior of the chamber passes through the at least one vent to equalize the pressure within the chamber to the ambient pressure exterior of the chamber.

9. The liquid supply vessel according to claim 6, wherein when an amount of the liquid maintained within the chamber is decreased, gas exterior of the chamber passes through the at least one vent to equalize the pressure within the chamber to the ambient pressure exterior of the chamber.

10. The liquid supply vessel according to claim 1, further comprising:

a fluidic interconnect provided in the opening, wherein the fluidic interconnect is permeable to the liquid but substantially blocks air bubbles when wetted.

11. The liquid supply vessel according to claim 10, wherein the fluidic interconnect is of a type selected from the group consisting of open-foam with a filter screen and septum/needle.

12. The liquid supply vessel according to claim 1, wherein the at least one vent is a membrane.

13. A method of preventing back-pressure from developing in the liquid supply vessel according to claim 1 when an amount of the liquid in the chamber decreases, the method comprising the steps of:

providing the liquid in the chamber;

expunging at least some of the liquid from the chamber through the opening; and sucking gas into the chamber in a manner that is impermeable to the liquid to equalize the pressure in the chamber with the ambient pressure exterior of the chamber, to prevent back-pressure from developing in the chamber.

14. A method of equalizing pressure in the liquid supply vessel according to claim 1 when the altitude and/or temperature at which the vessel is maintained is changed, the method comprising the steps of:

providing the liquid in the chamber;

changing the altitude and/or temperature at which the vessel is maintained; and equalizing the pressure in the chamber with the ambient pressure exterior of the chamber by sucking gas into, or exhausting gas out of, the chamber in a manner that is impermeable to the liquid, to equalize the pressure in the chamber.

15. The method according to claim 14, wherein the step of equalizing the pressure includes:

(a) exhausting gas if the temperature and/or altitude at which the vessel is maintained increases; or (b) sucking gas if the temperature and/or altitude at which the vessel is maintained decreases.

16. An inkjet ink cartridge comprising:

a chamber containing a supply of ink, wherein the chamber comprises a floor having an opening thereon;

an ink dispensing apparatus having an intake and an outtake, wherein a valve is positioned between the intake and the outtake, and wherein the outtake is aligned with the opening;

a supply line having an inlet adjacent the floor and an outlet in fluid communication with the intake, wherein the supply line extends from the floor and is substantially housed within the chamber; and at least one vent formed in a wall of the chamber, wherein the at least one vent is exposed to the ink within the chamber, and wherein the at least one vent is permeable to gas but substantially impermeable to the ink.

17. The inkjet ink cartridge according to claim 16, further comprising: a filter provided in the inlet of the supply line.

18. The inkjet ink cartridge according to claim 17, wherein the filter is adapted to prevent impurities in the ink from entering the supply line.

19. The inkjet ink cartridge according to claim 18, wherein the filter is permeable to the ink but substantially blocks air bubbles when wetted.

20. The inkjet ink cartridge according to claim 16, wherein the valve is an umbrella valve.

21. The inkjet ink cartridge according to claim 16, wherein the at least one vent is adapted to equalize the pressure within the chamber and the ambient pressure exterior of the chamber.

22. The inkjet ink cartridge according to claim 21, wherein when the altitude and/or temperature at which the vessel is maintained is increased, gas within the chamber passes through the at least one vent to equalize the pressure within the chamber to the ambient pressure exterior of the chamber.

23. The inkjet ink cartridge according to claim 21, wherein when the altitude and/or temperature at which the vessel is maintained is decreased, gas exterior of the chamber passes through the at least one vent to equalize the pressure within the chamber to the ambient pressure exterior of the chamber.

24. The inkjet ink cartridge according to claim 21, wherein when an amount of the ink maintained within the chamber is decreased, gas exterior of the chamber passes through the at least one vent to equalize the pressure within the chamber to the ambient pressure exterior of the chamber.

25. The inkjet ink cartridge according to claim 16, further comprising:

a fluidic interconnect provided in the opening, wherein the fluidic interconnect is permeable to liquid but substantially blocks air bubbles when wetted.

26. The inkjet ink cartridge according to claim 25, wherein the fluidic interconnect is of a type selected from the group consisting of open-foam and septum/needle.

27. The inkjet ink cartridge go according to claim 16 wherein the at least one vent is a membrane.

* * * * *

UNITED STATES PATENT AND TRADEMARK OFFICE

CERTIFICATE OF CORRECTION

PATENT NO. : 6,905,198 B2
APPLICATION NO. : 10/625589
DATED : June 14, 2005
INVENTOR(S) : Anthony D. Studer et al.

It is certified that error appears in the above-identified patent and that said Letters Patent is hereby corrected as shown below:

Claim 27, Column 6, line 64, after "cartridge" delete "go"

Signed and Sealed this

Eighth Day of September, 2009

David J. Kappos

David J. Kappos
*Director of the United States Patent and Trademark Office*